US007356998B2

(12) United States Patent
Lee et al.

(10) Patent No.: US 7,356,998 B2
(45) Date of Patent: Apr. 15, 2008

(54) FLASH TANK OF TWO-STAGE COMPRESSION HEAT PUMP SYSTEM FOR HEATING AND COOLING

(75) Inventors: Young Soo Lee, Seoul (KR); Wook Hyun Lee, Daejeon (KR); Jong Ryul Kim, Youngjoo (KR); Ki Chang Jang, Daejeon (KR); Seong Ryong Park, Daejeon (KR); Yong Jin Baik, Daejeon (KR); Ho Sang Ra, Daejeon (KR)

(73) Assignee: Korean Institute of Energy Research (KR)

( * ) Notice: Subject to any disclaimer, the term of this patent is extended or adjusted under 35 U.S.C. 154(b) by 253 days.

(21) Appl. No.: 11/326,126

(22) Filed: Jan. 5, 2006

(65) Prior Publication Data

US 2006/0174639 A1 Aug. 10, 2006

(30) Foreign Application Priority Data

Jan. 7, 2005 (KR) ..... 10-2005-0001527

(51) Int. Cl.
*F25B 13/00* (2006.01)
*F25B 42/02* (2006.01)

(52) U.S. Cl. ..... 62/160; 62/468

(58) Field of Classification Search ..... 62/160, 62/324.1, 228.3, 126, 324.4, 46, 470, 510
See application file for complete search history.

(56) References Cited

U.S. PATENT DOCUMENTS 4,023,738 A * 5/1977 Ogihara et al. ..... 241/271
4,100,762 A * 7/1978 Davis et al. ..... 62/160
4,326,387 A * 4/1982 Friedman ..... 62/184
4,942,741 A * 7/1990 Hancock et al. ..... 62/292
4,967,570 A * 11/1990 Van Steenburgh, Jr. ..... 62/292
5,074,213 A * 12/1991 Kurosawa ..... 101/487
5,400,609 A 3/1995 Sjoholm et al.
5,410,889 A 5/1995 Sjoholm et al.
5,465,587 A * 11/1995 Sjoholm et al. ..... 62/84

FOREIGN PATENT DOCUMENTS

JP 2001-336860 A * 12/2001

* cited by examiner

*Primary Examiner*—Mohammad M. Ali
(74) *Attorney, Agent, or Firm*—Michael Best & Friedrich

(57) ABSTRACT

Disclosed herein is a flash tank of a two-stage compression heat pump system that can perform cooling and heating with a separate type intercooler and a high-stage compressor protecting device. The system comprises a fluid-level detecting sensor for detecting the fluid-level of the refrigerant, an alarm sensor for notifying the saturated state of the refrigerant filled in the flash tank, an evaporator pressure sensor for measuring and notifying the pressure of the refrigerant flowing into the evaporator, a condenser pressure sensor for measuring and notifying the pressure of the refrigerant flowing out of the condenser, a flash tank fluid-level controller for receiving signals from the above sensors and controlling intermediate pressure and the fluid-level of the flash tank, and a bypass valve controller for controlling a bypass valve that receives signals from the alarm sensor and allowing a refrigerant to directly flow from the low-stage compressor to the high-stage compressor.

18 Claims, 4 Drawing Sheets

FLASH TANK OF TWO-STAGE COMPRESSION HEAT PUMP SYSTEM FOR HEATING AND COOLING

CROSS-REFERENCE TO RELATED APPLICATIONS

Priority is hereby claimed to Korean Patent Application Number 10-2005-0001527 filed on Jan. 7, 2005, the entire contents of which are incorporated herein by reference.

BACKGROUND OF THE INVENTION

1. Field of the Invention

The present invention relates to a two-stage compression heat pump system adapted to perform cooling and heating in a single unit, which performs a single-stage compressing operation in summertime and a two-stage compressing operation in wintertime, and which has a separate intercooler for controlling the system to provide optimum intermediate pressure, and a device for protecting a high-stage compressor through the control of a fluid-level inside a flash tank.

2. Background of the Related Art

Generally, a conventional system for performing cooling and heating in single unit is either a system having an air conditioner (or a chiller) and an electric heater, or a heat pump type air conditioner having one compressor.

However, in the former case where an air conditioner (or a chiller) and an electric heater are assembled in one package, excessive energy is consumed for heating. Even in the latter case of the heat pump type air conditioner that can save energy, if the temperature of a heat source is decreased in wintertime, such a system operates at an excessive compression ratio together with decreased evaporation pressure, and thus the operating efficiency of the compressor is lowered, and heating capacity is decreased due to the decrease of refrigerant mass flow rate in the system, thereby lowering system efficiency. In addition, if the evaporation pressure of the system is decreased, the compressor discharge gas temperature can be increased excessively, so that the system can be adversely influenced in terms of safety.

A two-stage compression system can exhibit excellent performance compared with conventional systems. However, conventional flash tanks do not have a device for detecting or removing fine droplets generated in the process of heat balance when refrigerant gas and a two-phase flow state are mixed, where the refrigerant gas is superheated vapor discharged from a low-stage compressor and the two-phase flow refrigerant, passed through an intercooler, has a liquid portion. Therefore, inflow of the fine droplets into a high-stage compressor cannot be blocked. Furthermore, an appropriate method of collecting refrigeration oil from the flash tank to the compressor has not been proposed, the refrigeration oil therefore being contained in the refrigerant gas from the low-stage compressor.

SUMMARY OF THE INVENTION

Therefore, the present invention has been made in view of the above problems occurring in the prior art, and it is an object of the present invention to provide a two-stage compression heat pump system having a flash tank which induces two refrigerants to reach thermal equilibrium smoothly, wherein the refrigerants have different states from each other and flow into the flash tank, to embody a two-stage compression cycle having complete intermediate cooling, to prevent fine droplets from flowing into a high-stage compressor in order to inhibit liquid back or liquid compression in the high-stage compressor, wherein the fine droplets are generated in the process of obtaining thermal equilibrium, and to allow the refrigeration oil flowing into the flash tank together with the refrigerant to be collected into the compressor in order to prevent refrigeration oil from remaining in a specific device so as to extend the life-span and enable stable operations of the device, thereby enhancing system reliability and performance.

To accomplish the above object, according to one aspect of the invention, there is provided a flash tank of a two-stage compression heat pump system for cooling and heating in one system, having an intercooler that maximizes cooling effect by increasing the degree of sub-cooling of a refrigerant sent to the flash tank and an evaporator, the two-stage compression heat pump system serving to perform a single-stage compression cooling operation in summertime using only a low-stage compressor for stable operations, and using both the low-stage compressor and a high-stage compressor in wintertime for highly efficient operations, wherein the flash tank and the intercooler are separately allocated. The two-stage compression heat pump system comprises: a fluid-level detecting sensor mounted inside the flash tank for detecting a fluid-level of the refrigerant; an alarm sensor for notifying a saturated state of the refrigerant filled in the flash tank; an evaporator pressure sensor for measuring and notifying pressure of the refrigerant flowing into the evaporator; a condenser pressure sensor for measuring and notifying pressure of the refrigerant flowing out of the condenser; a flash tank fluid-level controller for receiving signals from the above sensors and controlling intermediate pressure and the fluid-level of the flash tank; and a bypass valve controller for controlling a bypass valve that receives signals from the alarm sensor, allowing a refrigerant to directly flow from the low-stage compressor to the high-stage compressor. The flash tank comprises: an intercooler outlet pipe mounted on one side of the flash tank; a low-stage compressor outlet pipe mounted on the other side of the flash tank; a high-stage compressor inlet pipe installed inside the flash tank, wherein the high-stage compressor inlet pipe has an end portion of a U-shaped pipe formed at a bottom side of the flash tank, a refrigeration oil inlet provided at a bottom side of the U-shaped pipe, and another end portion connected to the high-stage compressor; and an orifice installed so as to correspond to the refrigeration oil inlet provided at the bottom side of the U-shaped pipe, wherein the orifice is provided for filtering contaminations in the refrigeration oil.

According to another aspect of the invention, there is also a flash tank of a two-stage compression heat pump system for cooling and heating in one system, having an intercooler that maximizes cooling effect by increasing the degree of sub-cooling of a refrigerant sent to the flash tank and an evaporator, the two-stage compression heat pump system serving to perform a single-stage compression cooling operation in summertime using only a low-stage compressor for stable operations, and using both the low-stage compressor and a high-stage compressor in wintertime for highly efficient operations, wherein the flash tank and the intercooler are separately allocated. The two-stage compression heat pump system comprises: a fluid-level detecting sensor mounted inside the flash tank for detecting a fluid-level of the refrigerant; an alarm sensor for notifying a saturated state of the refrigerant filled in the flash tank; an evaporator pressure sensor for measuring and notifying pressure of a refrigerant flowing into the evaporator; a condenser pressure sensor for measuring and notifying pressure of a refrigerant flowing out of the condenser; a flash tank fluid-level controller for receiving signals from the above sensors and controlling intermediate pressure and the fluid-level of the flash tank; and a bypass valve controller for controlling a bypass valve that receives signals from the alarm sensor, allowing a refrigerant to directly flow from the low-stage compressor to the high-stage compressor. The flash tank comprises: an intercooler outlet pipe mounted on one side of the flash tank; a low-stage compressor outlet pipe mounted on the other side of the flash tank; a helically-shaped pipe connected to the low-stage compressor outlet pipe; a refrigeration oil collecting tube connected to an end portion of the coil-shaped pipe for inducing refrigeration oil into a refrigeration oil tank; a refrigerant vapor discharge port formed at one side of the refrigeration oil collecting tube for discharging refrigerant vapor from the refrigeration oil collecting tube; and a high-stage compressor inlet pipe for inducing refrigerant vapor from the flash tank to the high-stage compressor.

According to another aspect of the invention, there is also provided a flash tank of a two-stage compression heat pump system, wherein the flash tank comprises: an intercooler outlet pipe mounted on one side of the flash tank; a low-stage compressor outlet pipe mounted on the other side of the flash tank; a helically-shaped pipe connected to a low-stage compressor outlet pipe; a refrigeration oil collecting tube connected to an end portion of the helically-shaped pipe for inducing refrigeration oil into a refrigeration oil tank; a refrigerant vapor discharge port formed at one side of the refrigeration oil collecting tube for discharging refrigerant vapor from the refrigeration oil collecting tube; and a high-stage compressor inlet pipe for inducing the refrigerant vapor from the flash tank to the high-stage compressor.

The two-stage compression heat pump system according to the invention, in a case where the two-stage compressor and the heat pump adopt a separate type intermediate cooling method, induces a stable heat exchange within the flash tank, the heat exchange being performed between the superheated vapor discharged from a low-stage and the refrigerant that has passed through an intercooler, but not turned into a saturated vapor, prevents a liquid back or liquid compression by blocking the droplets generated in the process of heat exchange from flowing into the high-stage compressor, and allows the refrigeration oil mixed with the refrigerant vapor discharged from a low-stage to be easily collected instead of being retained in the flash tank, and thus increases system reliability through device protection, and embodies a two-stage compression cycle with complete intermediate cooling, thereby greatly improving system performance.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Preferred embodiments of the invention will be hereafter described in detail, with reference to the accompanying drawings.

Figure 1:
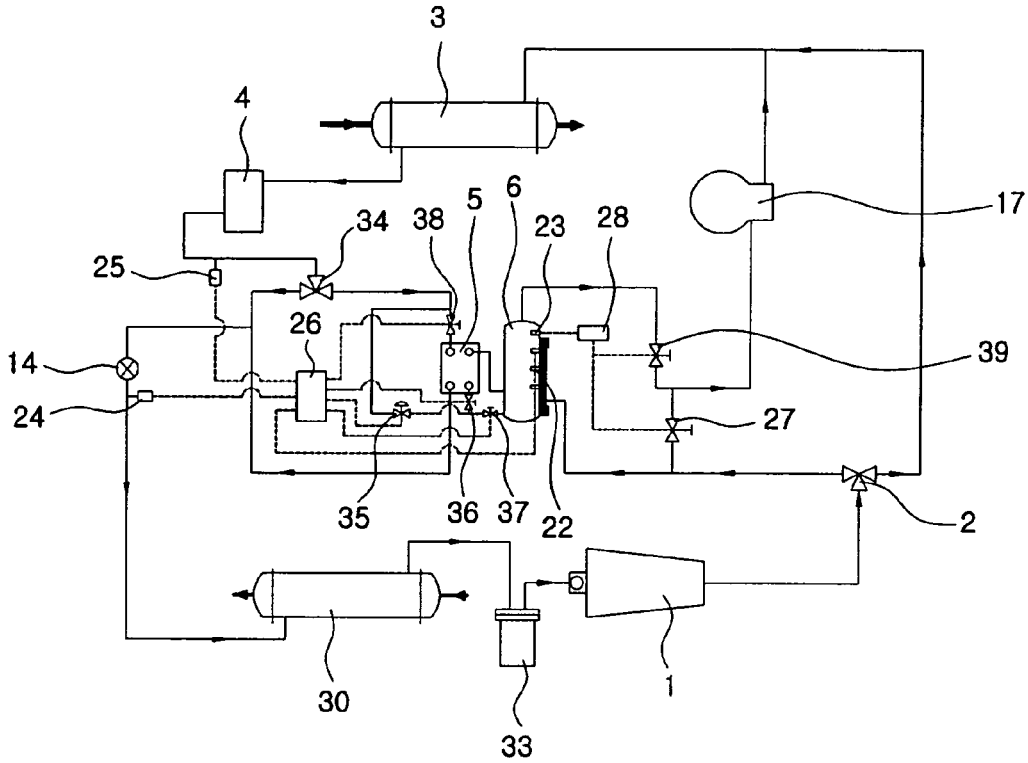
FIG. 1 schematically shows a two-stage compression heat pump system on which a flash tank is mounted according to an embodiment of the invention.
Figure 2:
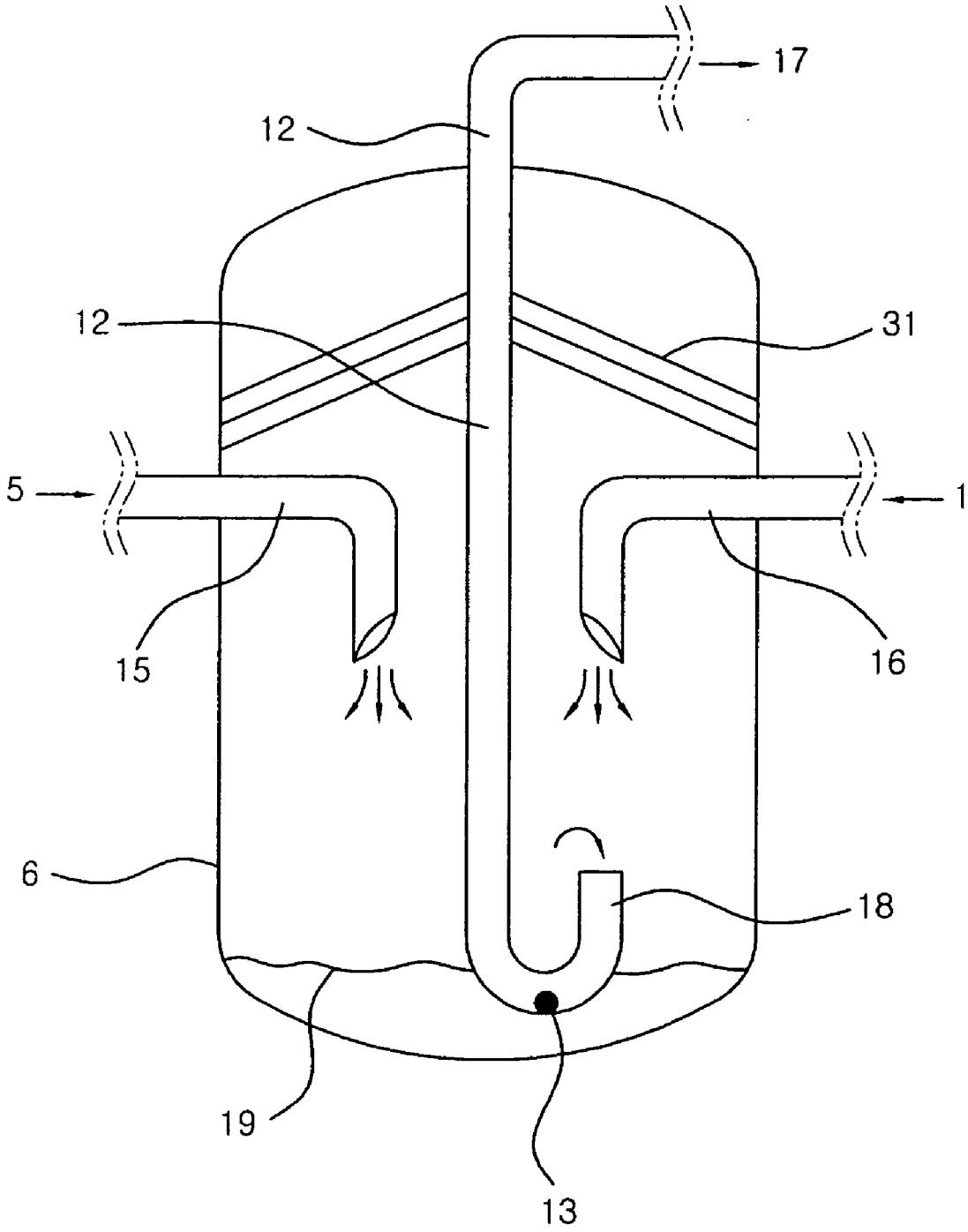
FIG. 2 schematically shows a flash tank according to an embodiment of the invention.

FIG. 1 schematically shows a two-stage compression heat pump system according to an embodiment of the invention, and FIG. 2 schematically shows a flash tank mounted on the two-stage compression heat pump system according to an embodiment of the invention, which will be explained in detail hereafter. A two-stage compression heat pump system equipped with a flash tank according to the invention is a cooling and heating system that performs cooling and heating in a single unit having an intercooler 5 that maximizes cooling effect by increasing the degree of sub-cooling of refrigerant sent to the flash tank 6 and an evaporator. The two-stage compression heat pump system performs a single-stage compression cooling operation in summertime using only a low-stage compressor 1 for stable operations, and uses both the low-stage compressor 1 and a high-stage compressor 17 in wintertime for highly efficient operations. The flash tank 6 and the intercooler 5 are separately allocated in the two-stage compression heat pump system. The two-stage compression heat pump system comprises a fluid-level detecting sensor 22 mounted inside the flash tank 6 for detecting the fluid-level of the refrigerant, an alarm sensor 23 for notifying the saturated state of the refrigerant filled in the flash tank 6, an evaporator pressure sensor 24 for measuring and notifying the pressure of the refrigerant flowing into the evaporator 30, a condenser pressure sensor 25 for measuring and notifying the pressure of the refrigerant flowing out of the condenser 3, a flash tank fluid-level controller 26 for receiving signals from the above sensors and controlling intermediate pressure and the fluid-level of the flash tank 6, and a bypass valve controller 28 for controlling a bypass valve 27 that receives signals from the alarm sensor 23 and allows refrigerant to directly flow from the low-stage compressor 1 to the high-stage compressor 17. The flash tank 6 includes an intercooler outlet pipe 15 (see FIG. 2) mounted on one side of the flash tank 6, a low-stage compressor outlet pipe 16 mounted on the other side of the flash tank 6, a high-stage compressor inlet pipe 12 installed inside the flash tank 6 and having an end portion of a U-shaped pipe 18 formed at the bottom side of the flash tank 6, a refrigeration oil inlet 13 provided at the bottom side of the U-shaped pipe 18, another end portion connected to the high-stage compressor 17, and an orifice 19 formed of a wire screen installed so as to correspond to the refrigeration oil inlet 13 provided at the bottom side of the U-shaped pipe 18, the orifice being provided for filtering contaminations in the refrigeration oil.

Here, baffles 31 are attached above the low-stage compressor outlet pipe 16 and the intercooler outlet pipe 15 in order to prevent inflow of liquid among the mixed refrigerant of vapor and liquid flowing into the flash tank 6.

Figure 3:
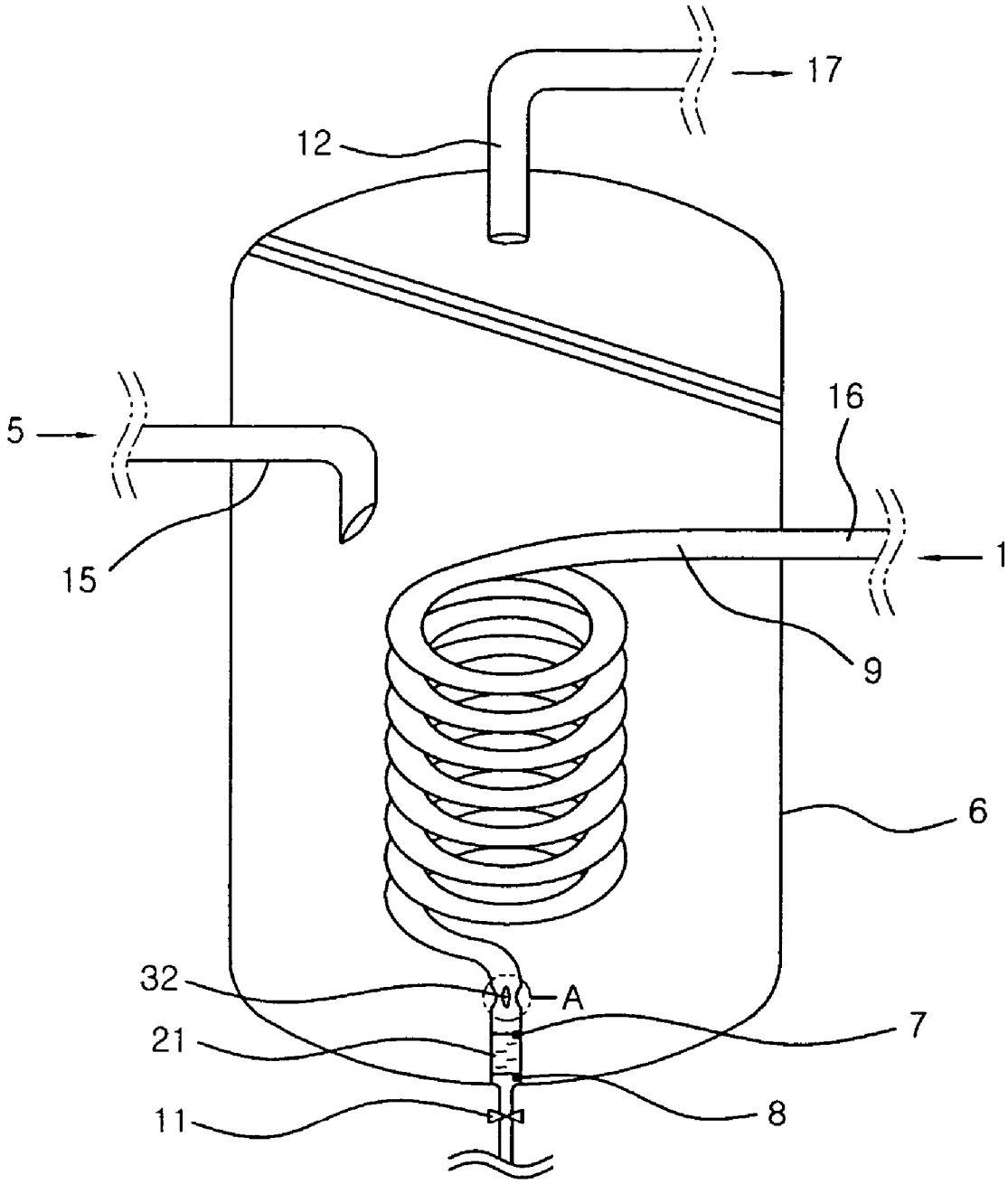
FIG. 3 schematically shows another embodiment of the flash tank according to the invention.

FIG. 3 schematically shows another embodiment of the flash tank mounted on the two-stage compression heat pump system according to an embodiment of the invention, which will be explained in detail below. The flash tank 6 of the two-stage compression heat pump system comprises an intercooler outlet pipe 15 mounted on one side of the flash tank 6, a low-stage compressor outlet pipe 16 mounted on the other side of the flash tank 6, a helically-shaped pipe 9 connected to the low-stage compressor outlet pipe 16, a refrigeration oil collecting tube 21 connected to the end portion of the helically-shaped pipe 9 for inducing the refrigeration oil into a refrigeration oil tank (not shown), a refrigerant vapor discharge port 32 formed at one side of the refrigeration oil collecting tube 21 for discharging refrigerant vapor from the refrigeration oil collecting tube 21, and a high-stage compressor inlet pipe 12 for inducing the refrigerant vapor from the flash tank 6 to the high-stage compressor 17.

A high-level switch 7 is installed at the refrigeration oil collecting tube 21, and a low-level switch 8 is installed at a relatively lower position spaced apart from the high-level switch 7. If refrigeration oil is filled up to the level of the high-level switch 7, a refrigeration oil valve 11 is turned on, and the refrigeration oil is collected into the refrigeration oil tank. If the refrigeration oil arrives at the level of the low-level switch 8, the refrigeration oil valve 11 is turned off.

The helically-shaped pipe 9 is installed at a lower position than the intercooler outlet pipe 15 so that the refrigerant injected from the intercooler 5 is sprayed onto the helically-shaped pipe 9.

Here, baffles 31 are attached above the intercooler outlet 15 and the low-stage compressor outlet pipe 16 in order to prevent the liquid among the mixed refrigerant of vapor and liquid flowing into the flash tank 6 from flowing into the high-stage compressor 17.

In this embodiment, the high-stage compressor inlet pipe 12 is mounted on the upper portion of the flash tank 6.

Figure 4:
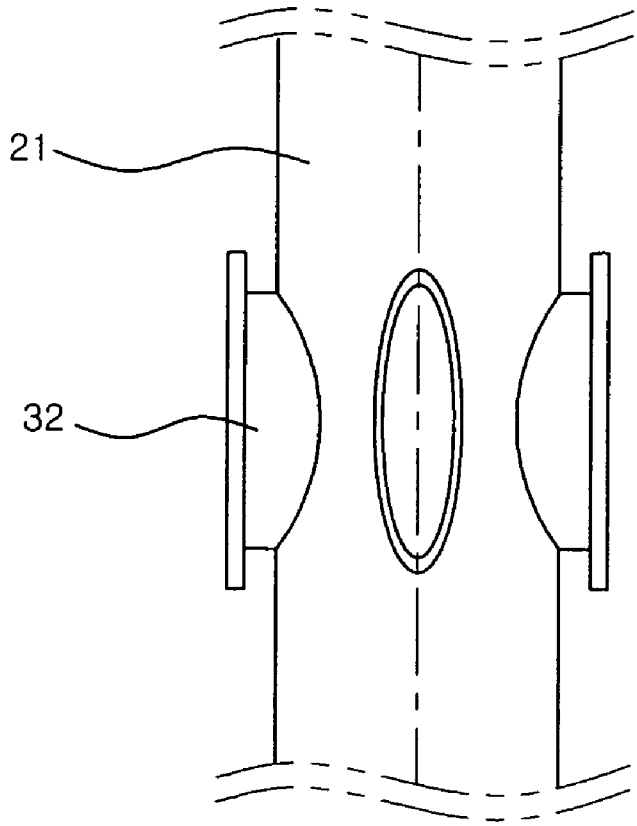
FIG. 4 schematically shows a refrigerant vapor discharge port of the flash tank according to an embodiment of the invention.
Figure 5:
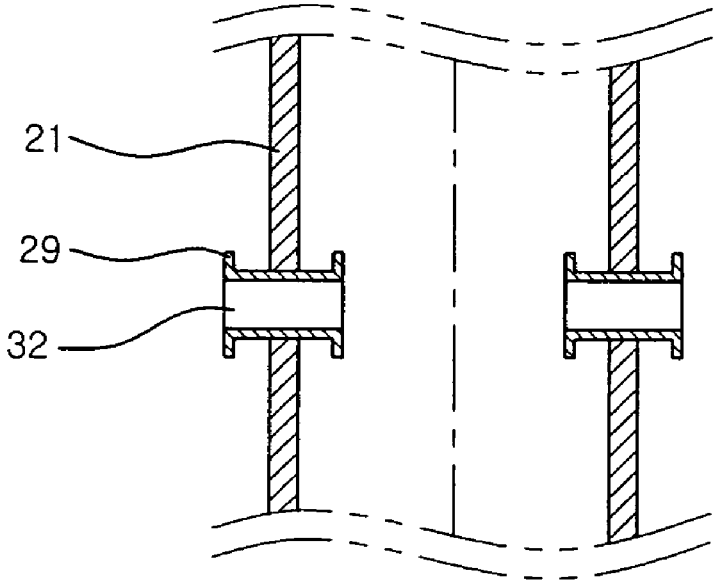
FIG. 5 schematically shows a refrigerant vapor anti-backflow device of the flash tank according to an embodiment of the invention.

FIG. 4 schematically shows a refrigerant vapor discharge port of the flash tank according to an embodiment of the invention, and FIG. 5 schematically shows a refrigerant vapor anti-backflow device of the flash tank according to an embodiment of the invention, which will be explained in detail below. The helically-shaped pipe 9 connected to the low-stage compressor 16 (see FIG. 3) is formed such that refrigerant vapor and refrigeration oil circulate along the outer wall surface of the helically-shaped pipe 9, and flow into the flash tank 6 through the refrigerant vapor discharge port 32.

In order to prevent the refrigerant vapor once flowing into the flash tank 6 from flowing backward into the helically-shaped pipe 9 again, the refrigerant gas anti-backflow device 29 having a protection latch is provided at the refrigerant vapor discharge port 32.

The operating principle of the two-stage compression heat pump system according to an embodiment of the invention will now be explained. In the summertime operating mode, refrigerant that has passed through an accumulator 33 after producing chilled water is compressed at the low-stage compressor 1, and flows into the condenser 3 through a first three-way valve 2. The condensed refrigerant is collected at a receiver tank 4, passes through a second three-way valve 34, expands while passing through a first expansion valve 14 of a main refrigerant line, flows into the evaporator 30, and produces chilled water again.

In the wintertime operating mode, refrigerant that has passed through the accumulator 33 after absorbing heat from heat source water is compressed at the low-stage compressor 1, and flows into the flash tank 6 via the first three-way valve 2. At the same time, some of the high-pressure liquid refrigerant that has passed the condenser 3, receiver tank 4, and second three-way valve 34 passes through a second expansion valve 35 of a subsidiary refrigerant line, and flow into the flash tank 6 by way of a first flow control valve for intermediate cooling 36, intercooler 5, and second flow control valve for intermediate cooling 37. Next, saturated vapor collected at the upper portion of the flash tank 6 is compressed again at the high-stage compressor 17, produces high-temperature water while passing the condenser 3, is collected at the receiver tank 4, passes through the second three-way valve 34, and passes a flow control valve 38 of the subsidiary refrigerant line and the intermediate cooler 5. Next, the saturated liquid is expanded while passing the first expansion valve 14, and flows into the evaporator 30 in order to absorb heat from the heat source.

In the processes described above, an intermediate pressure and flash tank fluid-level controller 26 is installed so as to obtain the maximum system operation efficiency for arbitrary high and low pressures. The input signals of the intermediate pressure and flash tank fluid-level controller 26 for obtaining optimum intermediate pressure are the output signal of the condenser pressure sensor 25, the output signal of evaporator pressure sensor 24, and the output signal of the fluid-level detecting sensor 22. In response to the above-mentioned three input signals, the intermediate pressure and flash tank fluid-level controller 26 controls the openings of the second expansion valve 35, the flow control valve 38 of the subsidiary refrigerant line, the first flow control valve for intermediate cooling 36, and the second flow control valve for intermediate cooling 37 in order to obtain optimum intermediate pressure within the limits of maintaining the safety level inside the flash tank 6.

In addition, the bypass valve controller 28 is installed in order to protect the high-stage compressor 17 even in the case where the system unexpectedly goes out of a control range, or in the case where the overall system operates unstably due to an external disturbance. The input signal of the bypass valve controller 28 is the output signal of the alarm sensor 23. If the output signal is "off", the bypass valve controller 28 closes the bypass valve 27, and opens a safety valve 39, and thus the system can operate normally. If the output signal of the fluid-level detecting sensor 22 is "on", the bypass valve controller 28 opens the bypass valve 27, and closes the safety valve 39, and thus prevents liquid refrigerant from flowing into the high-stage compressor 17, thereby securing the safety of the system.

While the present invention has been described with reference to the particular illustrated embodiments, it is not to be restricted by such embodiments, but only by the appended claims. It is to be appreciated that those skilled in the art can change or modify the embodiments without departing from the scope and spirit of the present invention.

What is claimed is:

1. A flash tank of a two-stage compression heat pump system for cooling and heating in a single unit, and in which an intercooler increases cooling effect by increasing a degree of sub-cooling of refrigerant sent to the flash tank and a separately-allocated evaporator, and in which the two-stage compression heat pump system performs a single-stage compression cooling operation in summertime using only a low-stage compressor, and both the low-stage compressor and a high-stage compressor in wintertime, wherein the two-stage compression heat pump system comprises:

a fluid-level detecting sensor mounted inside the flash tank for detecting a fluid-level of refrigerant;

an alarm sensor for notifying a saturated state of refrigerant in the flash tank;

an evaporator pressure sensor for measuring and notifying pressure of refrigerant flowing into the evaporator;

a condenser pressure sensor for measuring and notifying pressure of refrigerant flowing out of the condenser;

a flash tank fluid-level controller for receiving signals from the fluid-level detecting sensor, the alarm sensor, the evaporator pressure sensor, and the condenser pressure sensor and controlling intermediate pressure and the fluid-level of the flash tank; and a bypass valve controller for controlling a bypass valve that receives signals from the alarm sensor, the bypass valve controller allowing refrigerant to directly flow from the low-stage compressor to the high-stage compressor, the flash tank comprising:

an intercooler outlet pipe coupled on one side of the flash tank;

a low-stage compressor outlet pipe coupled on another side of the flash tank;

a high-stage compressor inlet pipe installed inside the flash tank, the high-stage compressor inlet pipe having a U-shaped end portion at a bottom of the flash tank, wherein a refrigeration oil inlet is provided at a bottom side of the U-shaped end portion, and wherein the high-stage compressor inlet pipe also has another end portion connected to the high-stage compressor; and an orifice installed so as to correspond to the refrigeration oil inlet provided at the bottom side of the U-shaped end portion, the orifice being provided for filtering contaminations in refrigeration oil.

2. The flash tank according to claim 1, further comprising baffles provided above the low-stage compressor outlet pipe and the intercooler outlet pipe in order to prevent an inflow of liquid amongst a mixed refrigerant of vapor and liquid flowing into the flash tank.

3. The flash tank according to claim 1, wherein the orifice is formed of a wire screen.

4. The flash tank according to claim 1, wherein, in order to obtain a desired intermediate pressure for system efficiency for arbitrary high pressure and low pressure within limits of maintaining a safety level inside the flash tank in a wintertime operation, an intermediate pressure and flash tank fluid-level controller receives input signals, including an output signal of the condenser pressure sensor, an output signal of the evaporator pressure sensor, and an output signal of the fluid-level detecting sensor, and controls openings of an expansion valve, a flow control valve of a subsidiary refrigerant line, a first flow control valve for intermediate cooling, and a second flow control valve for intermediate cooling.

5. The flash tank according to claim 1, wherein in the case of system operation outside of a desired control range or in the case of system instability due to an external disturbance, the bypass valve controller receives an output signal of the alarm sensor as an input signal in order to prevent liquid refrigerant from flowing into the high-stage compressor, wherein if the output signal of the alarm sensor is "off", the bypass valve controller closes the bypass valve, and opens a safety valve so that the system may operate normally, and wherein if the output signal of the alarm sensor is "on", the bypass valve controller opens the bypass valve, and closes the safety valve.

6. A flash tank of a two-stage compression heat pump system for cooling and heating in a single unit, and in which an intercooler increases cooling effect by increasing a degree of sub-cooling of refrigerant sent to the flash tank and a separately-allocated evaporator, and in which the two-stage compression heat pump system performs a single-stage compression cooling operation in summertime using only a low-stage compressor, and both the low-stage compressor and a high-stage compressor in wintertime, wherein the two-stage compression heat pump system comprises:

a fluid-level detecting sensor mounted inside the flash tank for detecting a fluid-level of refrigerant;

an alarm sensor for notifying a saturated state of refrigerant in the flash tank;

an evaporator pressure sensor for measuring and notifying pressure of refrigerant flowing into the evaporator;

a condenser pressure sensor for measuring and notifying pressure of refrigerant flowing out of the condenser;

a flash tank fluid-level controller for receiving signals from the fluid-level detecting sensor, the alarm sensor, the evaporator pressure sensor, and the condenser pressure sensor and controlling intermediate pressure and the fluid-level of the flash tank; and a bypass valve controller for controlling a bypass valve that receives signals from the alarm sensor, the bypass valve controller allowing refrigerant to directly flow from the low-stage compressor to the high-stage compressor, the flash tank comprising:

an intercooler outlet pipe coupled on one side of the flash tank;

a low-stage compressor outlet pipe coupled on another side of the flash tank;

a helically-shaped pipe coupled to the low-stage compressor outlet;

a refrigeration oil collecting tube coupled to an end portion of the helically-shaped pipe for inducing refrigeration oil into a refrigeration oil tank;

a refrigerant vapor discharge port at one side of the refrigeration oil collecting tube for discharging refrigerant vapor from the refrigeration oil collecting tube; and a high-stage compressor inlet pipe for inducing refrigerant vapor from the flash tank to the high-stage compressor.

7. The flash tank according to claim 6, wherein a high-level switch is located at the refrigeration oil collecting tube, and a low-level switch is installed at a lower position spaced from the high-level switch, wherein if refrigeration oil is filled up to a level of the high-level switch, a refrigeration oil valve is turned on, and refrigeration oil is collected into the refrigeration oil tank, and if the refrigeration oil arrives at a level of the low-level switch, the refrigeration oil valve is turned off.

8. The flash tank according to claim 6, wherein the helically-shaped pipe is installed at a lower position than the intercooler outlet pipe so that refrigerant injected from the intercooler is sprayed onto the helically-shaped pipe.

9. The flash tank according to claim 6, further comprising baffles located above the low-stage compressor outlet pipe and the intercooler outlet pipe in order to prevent inflow of liquid amongst a mixed refrigerant of vapor and liquid flowing into the flash tank.

10. The flash tank according to claim 6, wherein the high-stage compressor inlet pipe is coupled on an upper portion of the flash tank.

11. The flash tank according to claim 6, wherein a refrigerant gas anti-backflow device having a protection latch is provided at the refrigerant vapor discharge port in order to prevent refrigerant vapor flowing into the flash.

12. The flash tank according to claim 6, wherein, in order to obtain a desired intermediate pressure for system efficiency for arbitrary high pressure and low pressure within limits of maintaining a safety level inside the flash tank in a wintertime operation, an intermediate pressure and flash tank fluid-level controller receives input signals, including an output signal of the condenser pressure sensor, an output signal of the evaporator pressure sensor, and an output signal of the fluid-level detecting sensor, and controls openings of an expansion valve, a flow control valve of a subsidiary refrigerant line, a first flow control valve for intermediate cooling, and a second flow control valve for intermediate cooling.

13. The flash tank according to claim 6, wherein in the case of system operation outside of a desired control range or in the case of system instability due to an external disturbance, the bypass valve controller receives an output signal of the alarm sensor as an input signal in order to prevent liquid refrigerant from flowing into the high-stage compressor, wherein if the output signal of the alarm sensor is "off", the bypass valve controller closes the bypass valve, and opens a safety valve so that the system may operate normally, and wherein if the output signal of the alarm sensor is "on", the bypass valve controller opens the bypass valve, and closes the safety valve.

14. A flash tank of a two-stage compression heat pump system having a high-stage compressor, a refrigeration oil tank, and an intercooler, the flash tank comprising:

an intercooler outlet pipe coupled on one side of the flash tank;

a low-stage compressor outlet pipe coupled on another side of the flash tank;

a helically-shaped pipe coupled to a low-stage compressor outlet;

a refrigeration oil collecting tube coupled to an end portion of the helically-shaped pipe for inducing refrigeration oil into the refrigeration oil tank;

a refrigerant vapor discharge port at one side of the refrigeration oil collecting tube for discharging refrigerant vapor from the refrigeration oil collecting tube; and a high-stage compressor inlet pipe for inducing refrigerant vapor from the flash tank to a high-stage compressor.

15. The flash tank according to claim 14, wherein the helically-shaped pipe is installed at a lower position than the intercooler outlet pipe so that refrigerant injected from the intercooler is sprayed onto the helically-shaped pipe.

16. The flash tank according to claim 14, further comprising baffles located above the low-stage compressor outlet pipe and the intercooler outlet pipe in order to prevent inflow of liquid amongst a mixed refrigerant of vapor and liquid flowing into the flash tank.

17. The flash tank according to claim 14, wherein the high-stage compressor inlet pipe is coupled on an upper portion of the flash tank.

18. The flash tank according to claim 14, wherein a refrigerant gas anti-backflow device having a protection latch is provided at the refrigerant vapor discharge port in order to prevent refrigerant vapor flowing into the flash tank from flowing backward into the helically-shaped pipe.

* * * * *